US007530640B2

(12) United States Patent
Walters et al.

(10) Patent No.: US 7,530,640 B2
(45) Date of Patent: May 12, 2009

(54) LAYERED CHAIR BACK AND CHAIR SEAT

(75) Inventors: Joseph Lawrence Walters, Goshen, IN (US); Jesse Love, Bristol, IN (US); James Arlin Riegsecker, White Pigeon, MI (US)

(73) Assignee: L & P Property Management Company, South Gate, CA (US)

( * ) Notice: Subject to any disclaimer, the term of this patent is extended or adjusted under 35 U.S.C. 154(b) by 352 days.

(21) Appl. No.: 11/400,624

(22) Filed: Apr. 7, 2006

(65) Prior Publication Data

US 2007/0236073 A1 Oct. 11, 2007

(51) Int. Cl.
*A47C 7/00* (2006.01)

(52) U.S. Cl. ..... 297/440.22; 297/440.2; 297/452.27

(58) Field of Classification Search ..... 297/440.2, 297/440.22, 452.27, 452.35, 654; 5/655.5, 5/654

See application file for complete search history.

(56) References Cited

U.S. PATENT DOCUMENTS 4,643,481 A * 2/1987 Saloff et al. ..... 297/452.25 X
5,390,384 A * 2/1995 Dinsmoor et al. ..... 5/654 X
5,407,248 A * 4/1995 Jay et al. ..... 297/440.2 X
5,687,436 A * 11/1997 Denton ..... 5/653
6,082,824 A * 7/2000 Chow ..... 297/452.27
6,625,830 B2 * 9/2003 Lampel ..... 5/653

* cited by examiner

*Primary Examiner*—Anthony D Barfield
(74) *Attorney, Agent, or Firm*—Shook, Hardy & Bacon L.L.P.

(57) ABSTRACT

A chair having a base, a seat support mounted on the base, and a seat back support coupled with the seat support. The chair further includes a seat support assembly coupled with the seat support and a back support assembly coupled with the back support. The seat support assembly is a multi layered piece having a base layer, an intermediate layer, a gel pad, a tail pad, and a top layer. Once assembled the seat support assembly has a relief area that corresponds to the tail bone region of the user. The back support assembly is multi layered piece having a base layer, an intermediate layer, a support pad assembly, and a top layer. The ordering of the layers and the orientation of the support pad assembly provide support to the user without any direct or focalized pressure being distributed to specific regions of the body.

10 Claims, 5 Drawing Sheets

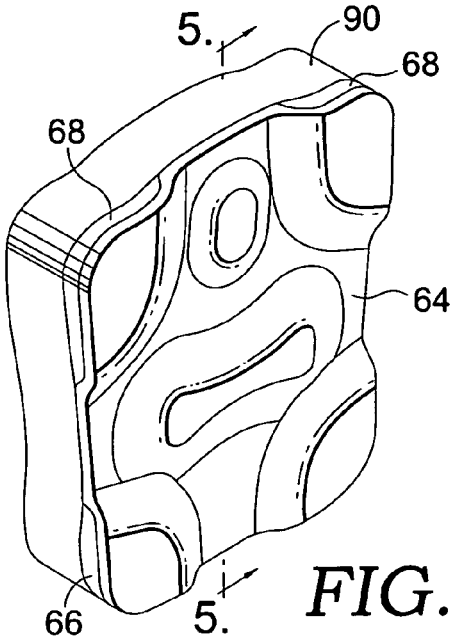
FIG. 4.
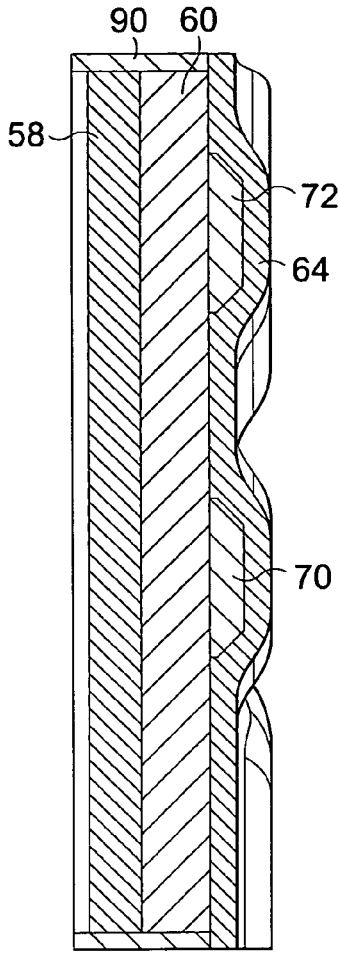
FIG. 5.
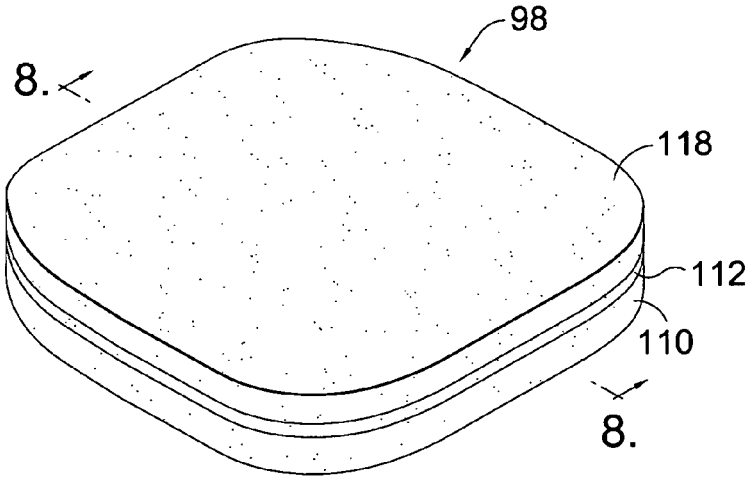
FIG. 7.
FIG. 8.
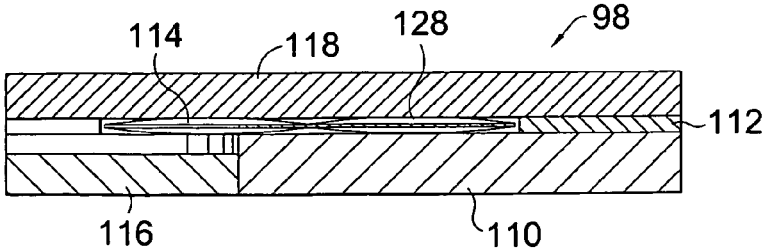

LAYERED CHAIR BACK AND CHAIR SEAT

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

This invention relates generally to a chair back and chair seat, and more particularly to a layered chair back and chair seat with a tailbone relief area.

Typical office chairs and the like are generally provided to support a user throughout the day in a seated position. However, due to the time spent seated at a chair during the normal business day, a user's body may become sore due to constant contact between the body and specific areas of the chair. Further, if a user suffers an injury to their tailbone or coccyx, a standard chair may further injure the user due to constant pressure on the effected area.

Thus, while office chairs are known in the art, it would be desirable to provide a seat and back for a chair that provides firm support for the user without using direct or focalized pressure.

SUMMARY OF THE INVENTION

Accordingly, the present invention provides an office chair that utilizes multiple layers of different kinds of foam to create a chair back and seat assembly that provide support to the targeted areas of the user without specifically providing direct or focalized pressure. The chair back assembly and seat assembly are mounted on a typical office chair.

The chair back assembly contains a support assembly, a mounting assembly, and a lumbar adjustor. The mounting assembly is coupled with the support assembly and is used to couple the chair back assembly to the chair. The mounting assembly includes first and second members made from pressure formed hardwood laminate. The support assembly is a multi layered piece having a base layer, an intermediate layer, a support pad assembly, and a top layer. The layers of the support assembly are coupled together and to the mounting assembly by a spray adhesive. Once assembled the support assembly provides a unique support configuration due to the ordering and type of materials used on the individual layers. Specifically, the ordering is such that firm support is provided to the lumbar region and the upper back portions due to the placement of the support pad assembly. However, since the top and intermediate layers are formed from memory foam no direct or focalized pressure is distributed to the specific regions of the body. Thus, the result of this configuration is a chair back assembly which forms and adapts to the shape of the user through memory foam while also providing centralized support to the lumbar and upper back regions.

The seat assembly includes a support assembly, a seat plate, and a cover. The support assembly is received on the seat plate. As such the seat plate is used to couple the seat assembly to the chair. The support assembly is a multi layered piece having a base layer, an intermediate layer, a gel pad, a tail pad, and a top layer. The layers of the support assembly are coupled together and to the seat plate by a spray adhesive.

When assembled, the seat assembly contains a relief area that corresponds to the tailbone or coccyx region of the user. As such, when seated, the relief area allows the user to sit on the seat assembly without any pressure being applied to the user's coccyx or tailbone.

Additional advantages, and novel features of the invention will be set forth in part in a description which follows, and in part will become apparent to those skilled in the art upon examination of the following, or may be learned by practice of the invention.

BRIEF DESCRIPTION OF THE SEVERAL VIEWS OF THE DRAWING

In the accompanying drawings which form a part of the specification and which are to be read in conjunction therewith, and in which like reference numerals are used to indicate like parts in the various views:

FIG. 4 is a fully assembled view of the back support;

FIG. 5 is a cross-sectional view of the back of FIG. 4 taken along the line 5-5;

FIG. 7 is an assembled view of the seat assembly;

FIG. 8 is a cross-sectional view of the seat of FIG. 7 taken along the line 8-8.

DETAILED DESCRIPTION OF THE INVENTION

Figure 1:
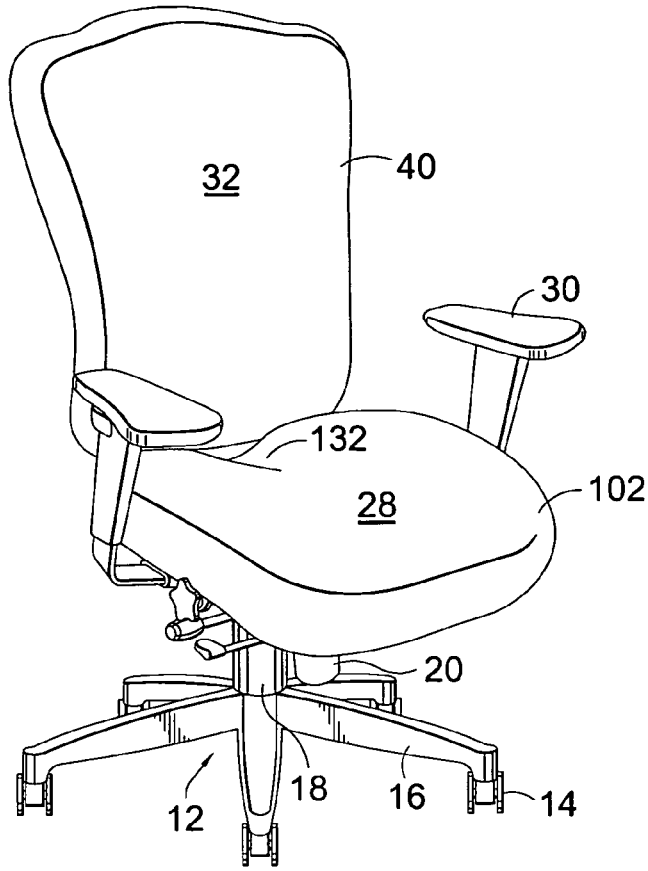
FIG. 1 is a perspective view of a chair having a chair back assembly and a seat assembly.

With initial reference to FIG. 1, a chair embodying the principles of the invention is generally indicated by reference numeral 10. The chair 10 is equipped with a base assembly 12. The base 12 preferably has a number of castors 14 operably supported on the outer ends of a corresponding number of support legs 16. The support legs 16 converge to a pedestal column 18. Preferably, the pedestal column 18 and the support legs 16 are integrally formed in one piece. The column 18 preferably supports a gas cylinder 20. As is known to those of skill in the art, the gas cylinder 20 allows the height of the chair to be adjusted by an occupant. The construction of the base 12 and column 18 is well known to those of skill in the chair industry.

Figure 2:
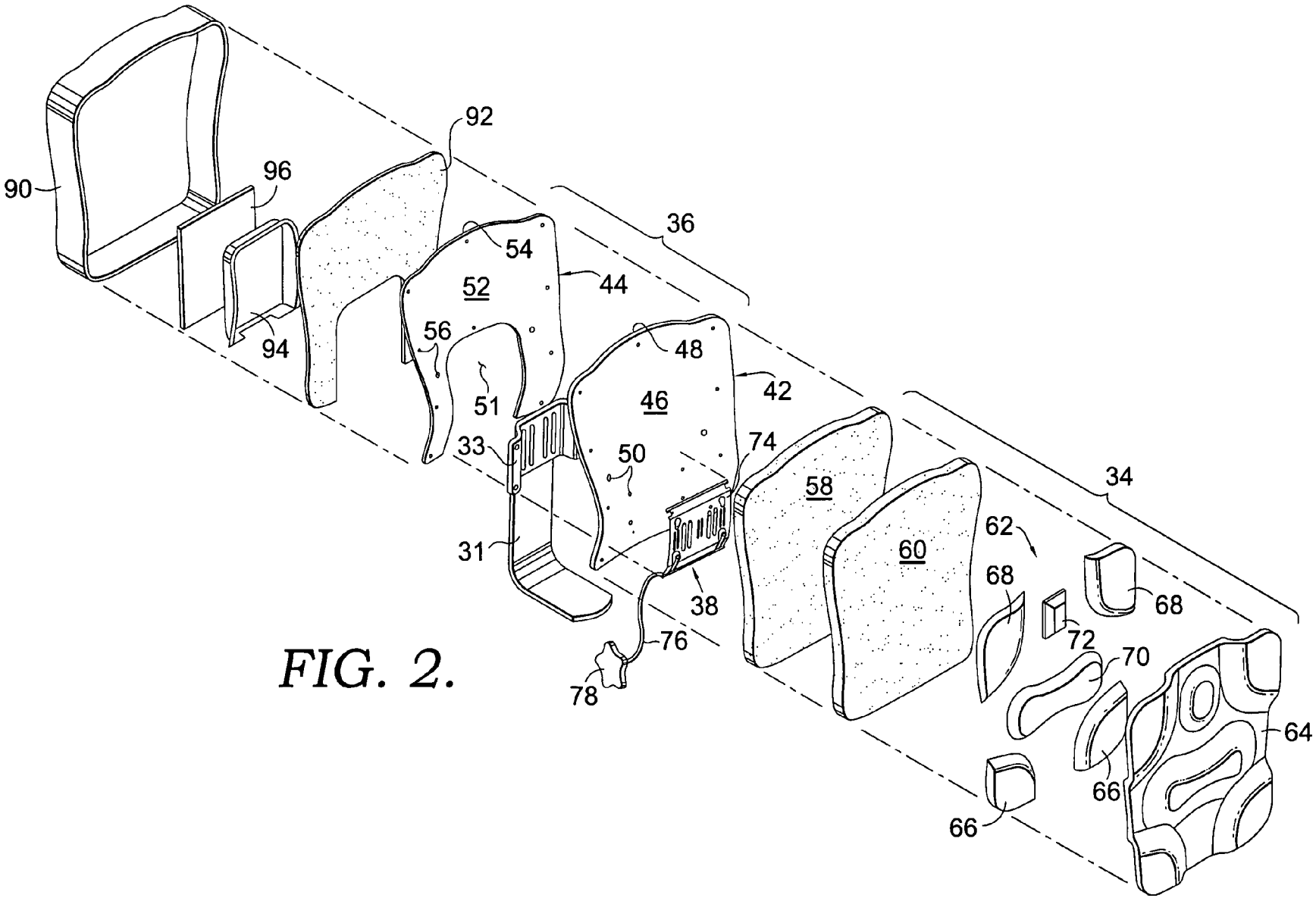
FIG. 2 is an exploded view of the chair back assembly.
Figure 6:
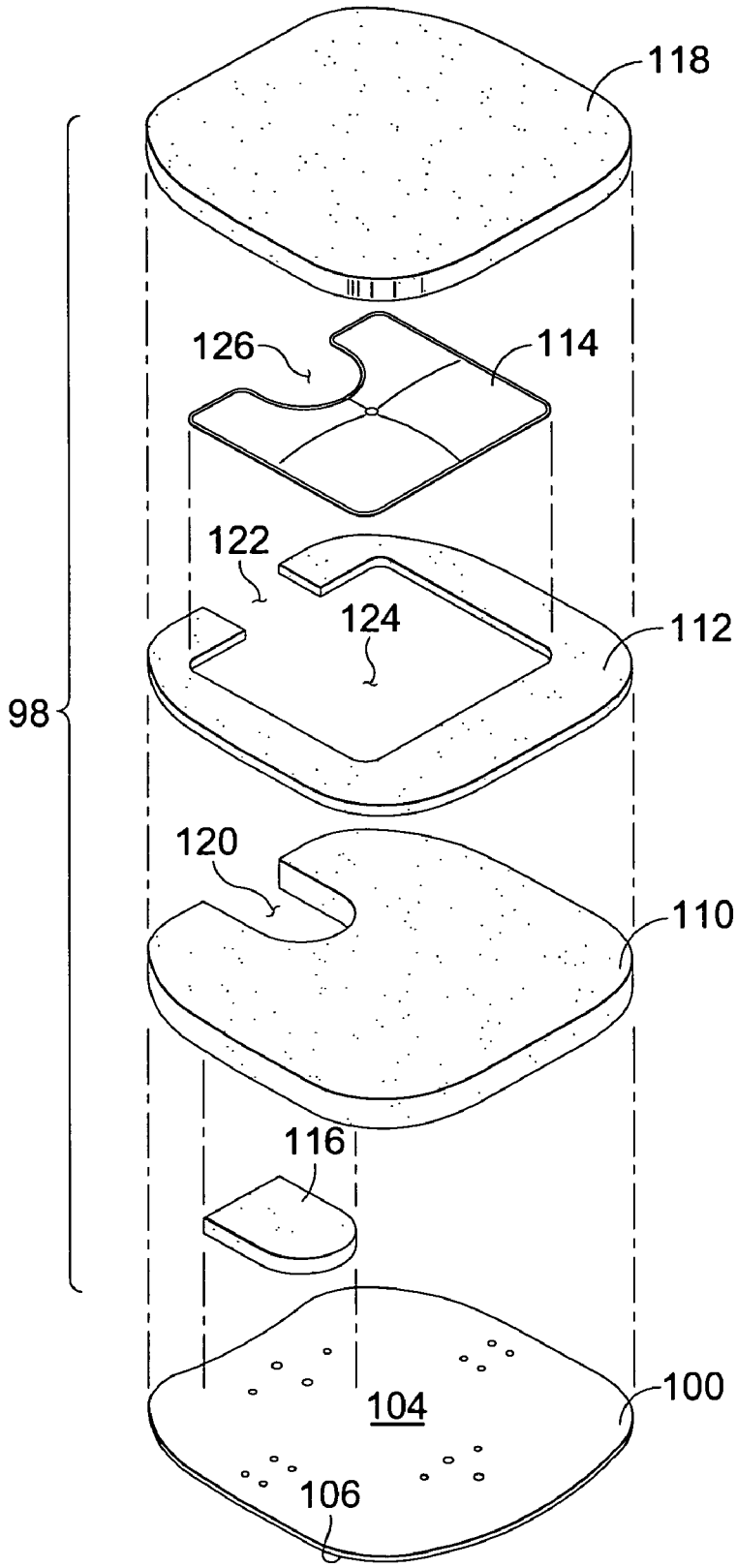
FIG. 6 is an exploded view of the seat assembly.
Figure 9:
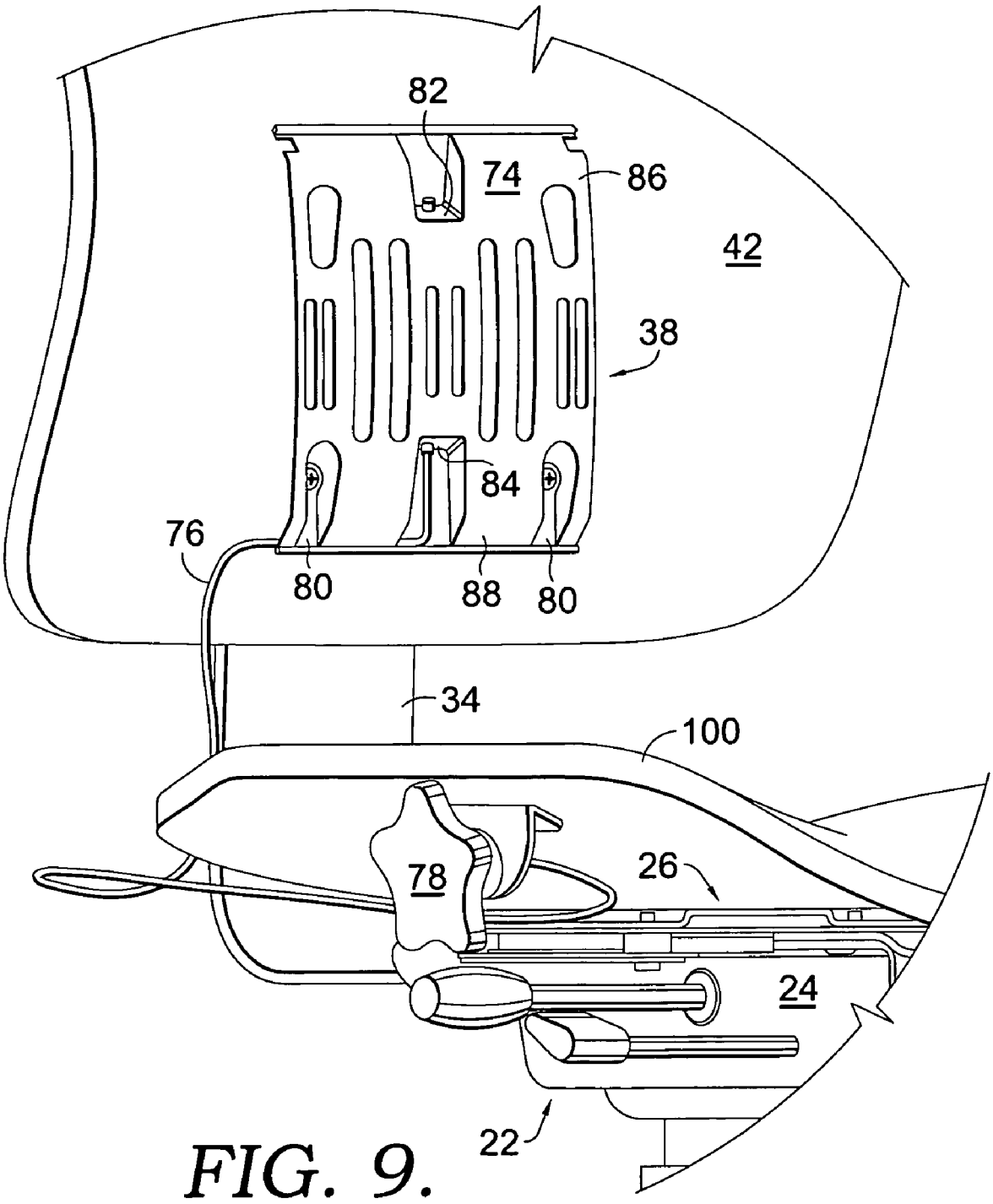
FIG. 9 is a partial, rear view of the chair showing the lumbar adjustment mechanism.

Referring now to FIGS. 1 and 9, a tilt control mechanism 22 is shown coupled to the gas cylinder 20. It is understood by one of ordinary skill in the art that the tilt control mechanism 22 contains a housing 24 and various internal parts that control the tilt of the chair. The tilt control mechanism 22 supports a seat-depth adjustment mechanism 26 to which a seat assembly 28 is coupled. Specifically, the seat assembly 28 is coupled to the seat-depth adjustment mechanism 26 which is, in turn, coupled to the tilt control mechanism 22. The tilt control mechanism 22 includes a hole in its bottom, not shown, that accommodates an upper portion of gas cylinder 20. The upper portion of cylinder 20 is then secured to tilt control mechanism 22 so that as the cylinder 20 extends and retracts, the tilt control mechanism 22 correspondingly moves up and down. Preferably, this coupling is accomplished via a tapered bushing, as is known to those of skill in the art. A pair of armrests 30 and a chair back assembly 32 are also coupled to the tilt control mechanism 22. While not discussed, the height of the armrests 30 as well and the distance between the armrests 30 may be adjusted, as is known by one of ordinary skill in the art. As shown in FIGS. 1, 2 and 9, coupling of the chair back assembly 32 to the tilt control mechanism 22 is accomplished by a J-back support bar 31 and an adjustment assembly 33. The adjustment assembly 33 serves to allow the height of the chair back assembly 32 to be adjusted with respect to the seat assembly 28.

The seat-depth adjustment mechanism 26 is affixed to the tilt control mechanism 22. The tilt control mechanism 22 typically operationally couples the base 12, the seat assembly 28, and the back 32, as known to those of skill in the art. The seat-depth adjustment mechanism 26 serves to adjust the depth of the seat assembly 28 with respect to the back assembly 32.

Referring now to FIGS. 2-5 and 9 the chair back assembly 32 will be discussed. The back assembly 32 contains a support assembly 34, a mounting assembly 36, a lumbar adjustor 38, and a cover 40, shown in FIG. 1. Specifically, the mounting assembly 36 is coupled with the support assembly 34, both of which are enclosed within the cover 40. As such, the mounting assembly 36 is used to couple the chair back assembly 32 to the adjustment assembly 33. Further, the lumbar adjustor 38 is coupled between the mounting assembly 36 and the support assembly 34 as will be further discussed below.

The mounting assembly 36 includes a first member 42 and a second member 44. The first and second members 42, 44 are made from pressure formed hardwood laminate. However it should be understood that any suitable material may be used. The first member 42 is shaped as shown and includes a concave inner surface 46, an outer surface 48, and a plurality of holes 50. The support assembly 34 contacts the inner surface 46 of the first member 42 once assembled. The second member 44 is shaped as shown and includes a void 51, a concave inner surface 52, an outer surface 54, and a plurality of holes 56. The concave inner surface 52 of the second member 44 is coupled to the outer surface 48 of the first member 42.

Figure 3:
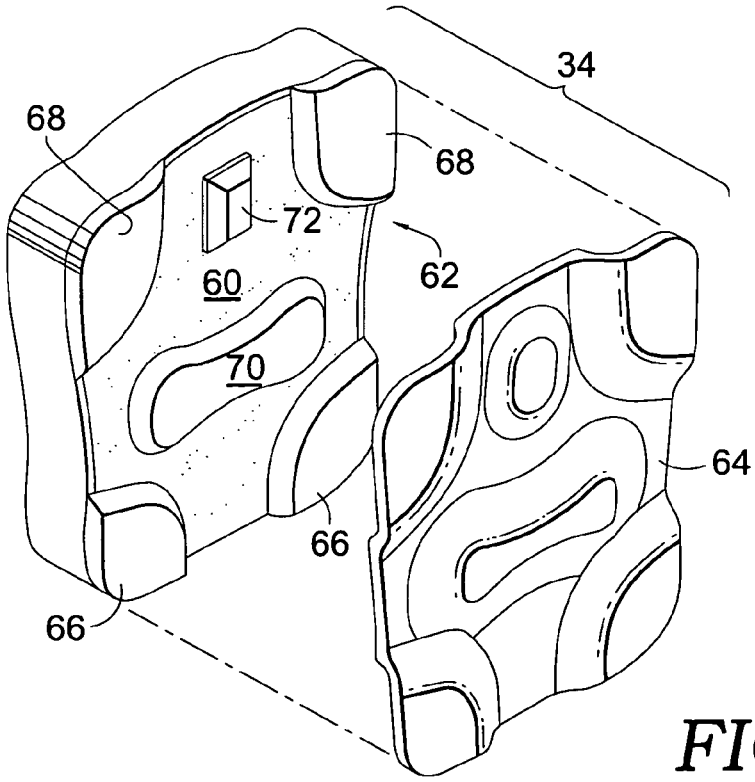
FIG. 3 is a partially assembled view of the back support assembly with the top layer removed to show placement of the supports pads.

The support assembly 34 is a multi layered piece having a base layer 58, an intermediate layer 60, a support pad assembly 62, and a top layer 64. FIG. 4 shows the fully assembled support assembly 34 while FIG. 3 shows the support assembly 34 with the top layer 64 removed to show the placement of the support pad assembly 62. The layers of the support assembly 34 are coupled together and with the mounting assembly 36 by a spray adhesive. However, it should be understood by one of ordinary skill in the art that any suitable coupling method may be used.

Referring now to FIGS. 2 and 5, the base layer 58 will be discussed. The base layer 58 is shaped as shown and made from a 1.5-inch thick fabricated, high-resilience, urethane foam pad with a density of 2.55 pounds per cubic foot (PCF). However it should be understood that any similar suitable material may be used. The base layer 58 is ergonomically shaped, contoured, and coupled with the first member 42 of the mounting assembly 36 such that it conforms to the shape thereof. As such, the shape of the first member 42 tends to shape the support assembly 34.

The intermediate layer 60 is shaped as shown and is formed from a 2-inch thick fabricated, urethane memory foam pad with a density of 4 PCF. The intermediate layer 60 is coupled with the base layer 58 such that it is shaped and contoured in accordance with the base layer 58 and first member 42 of the mounting assembly 36.

Referring now to FIGS. 2 and 3, the support pad assembly 62 will be discussed. The support pad assembly 62 is coupled with the intermediate layer 60. The support pad assembly 62 includes a pair of lower pads 66, a pair of upper pads 68, a lumbar pad 70, and a center pad 72 that are placed as shown in FIG. 3. Each of the pads in the support pad assembly 62 is made from a 1-inch thick fabricated, urethane foam with a density of 1.85 PCF. The support pads 66, 68, 70, 72 are placed on the intermediate layer 60 in the manner shown in FIG. 3 to provide support to the upper back and lumbar regions of the user. Specifically, it should be understood that the upper pads 68 are coupled with an upper region of the intermediate layer 60 while the lower pads 66 are coupled with a lower region of the intermediate layer 60. Further, the lumbar pad 70 is coupled to a location intermediate the upper and lower regions of the intermediate layer 60 while the center pad 72 is coupled between the upper pads 68 proximate the upper region of the intermediate layer 60.

Referring now to FIGS. 2-4, the top layer will be discussed. The top layer 64 is shaped as shown and is formed from a ¾-inch thick fabricated, urethane memory foam pad with a density of 4 PCF. The top layer 64 is ergonomically shaped, contoured, and coupled with the intermediate layer 60 and the support pad assembly 62.

Referring now to FIGS. 2 and 9 the lumbar adjustor 38 will be discussed. The lumbar adjustor 38 includes a flex plate 74, a cable 76, and a knob 78. The knob 78 is coupled to the seat assembly 28 and the cable 76 runs from the knob 78 to the flex plate 74. It should be understood that the cable 76 is attached to the knob 78 in a traditional manner such that turning the knob 78 translates into movement of the cable 76. The flex plate 74 is formed from spring steel and contains a pair of tabs 80 and a pair of cable attachment points 82, 84. The tabs 80 are affixed to the first member 42 of the mounting assembly 36 and are used to attach the flex plate 74 thereto. As such the flex plate 74 is mounted to the first member 42 at its lower portion. Further, the flex plate 74 is sandwiched between the first member 42 of the mounting assembly 36 and the base layer 58 of the support assembly 34. The cable attachment points 82, 84 are located at an upper portion 86 and a lower potion 88 of the flex plate 74, and the cable 76 is attached to each of the cable attachment points 82, 84 on the flex plate 74. Thus, when the knob 78 is turned in a clockwise direction, the cable 76 shortens causing the flex plate 74 to contract and bow outwardly from the inner surface 46 of the first member 42. This bowing movement of the flex plate 74 provides additional support to the lumbar region of the user through contact with the support assembly 34. It should be understood that when the knob 78 is turned in a counterclockwise direction, the cable 76 lengthens thereby causing the flex plate 74 to return to its initial position.

Referring now to FIGS. 2 and 5, the chair back assembly 32 also includes several additional pieces. Specifically, the chair back assembly includes a border 90, a back foam layer 92, and a cap 94. The back foam layer 92 is coupled to the outer surface 54 of the second member 44 of the mounting assembly 36 by spray adhesive. The cap 94 is coupled to the first member 42 within the void 51 of the second member 44 of the mounting assembly 36. The cap 94 serves to conceal a portion of the J-back support bar 31 and the adjustment assembly 33. The cap 94 is then covered with a vinyl material 96. The border 90 is then place around the perimeter of the chair back assembly 32, as shown in FIGS. 2, 4, and 5. The cover 40 is then applied to the chair back assembly 32 for final assembly.

As such, once assembled the support assembly 34 provides a unique support configuration, shown in FIGS. 3-5, due to the ordering and type of materials used on the base layer 58, the intermediate layer 60, the support pad assembly 62, and the top layer 64. Specifically, the ordering is such that firm support is provided to the lumbar region and the upper back portions due to the pair of upper pads 68, the pair of lower pads 66, the lumbar pad 70, and the center pad 72. However, due to the top and intermediate layers 64, 60 being formed from the memory foam pad material, no direct or focalized pressure is distributed to these regions of the body. Thus, the result of this configuration is a chair back assembly 32 which forms and adapts to the shape of the user through memory foam but also provides centralized support to the lumbar and upper back regions at the same time through the use of the support pad assembly 62, specifically, the placement of the pair of upper pads 68, the pair of lower pads 66, the lumbar pad 70, and the center pad 72.

Referring now to FIGS. 1 and 6-9, the seat assembly 28 will be discussed. The seat assembly 28 includes a support assembly 98, a seat plate 100, and a cover 102, shown in FIG. 1. The support assembly 98 is received on the seat plate 100, both of which are enclosed within the cover 102. As such, the seat plate 100 is used to couple the seat assembly 28 with the seat-depth adjustment mechanism 26. The seat plate 100 is made from pressure formed gumwood laminate. However, it should be understood that any suitable material may be used. The seat plate 100 is shaped as shown and includes a concave upper surface 104, a lower surface 106, and a plurality of holes 108. The support assembly 98 contacts the upper surface 104 and is received thereon.

The support assembly 98 is a multi layered piece having a base layer 110, an intermediate layer 112, a gel pad 114, a tail pad 116, and a top layer 118. The layers of the support assembly 98 are coupled together and to the seat plate 100 by a spray adhesive. However, it should be understood by one of ordinary skill in the art that any suitable coupling method may be used.

The base layer 110 is shaped as shown and made from a 2.0-inch thick fabricated, urethane foam pad with a density of 2.5-2.6 PCF. However it should be understood that any suitable material may be used. The base layer 110 is coupled with the seat plate 100 such that it conforms to the shape thereof. As such, the shape of the seat plate 100 tends to shape the support assembly 98 of the seat. The base layer 110 contains a void 120 that corresponds to the coccyx or tailbone area of the user as will be further discussed below.

The tail pad 116 is shaped as shown and fits within the void 120 in the base layer 110. The tail pad 116 is made from a 1¼-inch thick fabricated, urethane foam with a density of 2.5-2.6 PCF. The tail pad 116 is coupled with the seat plate 100 in the void 120 of the base layer 110.

The intermediate layer 112 is shaped as shown and is formed from a ½-inch thick fabricated, urethane foam with a density of 2.5-2.6 PCF. The intermediate layer 112 is coupled with the base layer 110. The intermediate layer 112 contains an outer void 122 that aligns with the void 120 of the base layer 110. The intermediate layer 112 further contains an inner void 124 that is generally rectangular and receives the gel pad 114. The gel pad 114 is shaped as shown and made from a clear polyurethane film and contains a void 126 that aligns with the outer void 122 of the intermediate layer 112 and the void 120 of the base layer 110. The gel pad 114 is configured to include a plurality of cavities, each of which is filled with a support gel 130.

The top layer 118 is shaped as shown and is formed from a 1½inch thick fabricated, urethane memory foam pad with a density of 4 PCF. The top layer 118 is coupled with the intermediate layer 112. When assembled, as shown in FIGS. 1 and 7, the seat assembly 28 contains a relief area 132 that corresponds to the tailbone or coccyx region of the user. As such, when seated, the relief area 132 allows the user to sit on the seat assembly without any pressure being applied to the user's coccyx or tailbone.

The present invention has been described in relation to particular embodiments, which are intended in all respects to be illustrative rather than restrictive. Alternative embodiments will become apparent to those skilled in the art to which the present invention pertains without departing from its scope.

It will be seen from the foregoing that this invention is one well adapted to attain the ends and objects set forth above, and to attain other advantages, which are obvious and inherent in the device. It will be understood that certain features and subcombinations are of utility and may be employed without reference to other features and subcombinations. This is contemplated. It will be appreciated by persons skilled in the art that the present invention is not limited to what has been particularly shown and described hereinabove. Rather, all matter herein set forth or shown in the accompanying drawings is to be interpreted as illustrative and not limiting.

What is claimed is:

1. A chair having a base, a seat support mounted on the base, and a seat back support coupled with the seat support, the chair comprising:

a seat support assembly coupled with the seat support, the seat support assembly having a urethane foam base layer with a void, a urethane foam intermediate layer coupled with the urethane foam base layer, the urethane foam intermediate layer having an inner void and an outer void, a gel pad having a void, the gel pad being received within the outer void of the urethane foam intermediate layer and coupled with the urethane foam base layer, a urethane memory foam top layer coupled with the urethane foam intermediate layer, wherein the void of the urethane foam base layer and the inner void of the urethane foam intermediate layer and the void of the gel pad align to create a relief area in the seat support assembly, and a urethane foam tail pad coupled with the seat support and received within the void in the urethane foam base layer; and a back support assembly coupled with the back support, the back support assembly having a urethane foam base layer, a urethane memory foam intermediate layer coupled with the urethane foam base layer, a support pad assembly coupled with the urethane memory foam intermediate layer, and a urethane memory foam top layer coupled with the urethane memory foam intermediate layer and the support pad assembly, wherein the support pad assembly includes a pair of lower pads, a pair of upper pads, a lumbar pad, and a center pad, each of the pads being made from urethane foam.

2. The chair as recited in claim 1, wherein the density of the urethane foam is less than the density of the urethane memory foam.

3. The chair as recited in claim 2, wherein the density of the urethane foam is between 2.5 and 2.6 pounds per cubic foot (PCF).

4. The chair as recited in claim 3, wherein the density of the urethane memory foam is 4 PCF.

5. The chair as recited in claim 1, further including a lumbar adjustor coupled with the back support, the lumbar adjustor being sandwiched between the back support and the urethane foam base layer.

6. The chair as recited in claim 5, wherein the lumbar adjustor includes a knob, a cable, and a flex plate, wherein rotation of the knob causes the flex plate to bow outwardly from the back support.

7. The chair as recited in claim 6, wherein the flex plate is aligned with the lumbar pad.

8. A seat support assembly for use with a chair, the seat support assembly comprising:

a urethane foam base layer with a void, a urethane foam tail pad received within the void in the urethane foam base layer, a urethane foam intermediate layer coupled with the urethane foam base layer, the urethane foam intermediate layer having an inner void and an outer void, a gel pad having a void, the gel pad being received within the outer void of the urethane foam intermediate layer and coupled with the urethane foam base layer, and a urethane memory foam top layer coupled with the urethane foam intermediate layer, wherein the void of the urethane foam base layer and the inner void of the urethane foam intermediate layer and the void of the gel pad align to create a relief area in the seat support assembly, and further wherein the density of the urethane foam is less than the density of the urethane memory foam.

9. The seat support assembly as recited in claim 8, wherein the density of the urethane foam is between 2.5 and 2.6 pounds per cubic foot (PCF).

10. The seat support assembly as recited in claim 9, wherein the density of the urethane memory foam is 4 PCF.

* * * * *